US005357838A

United States Patent [19]

Kurosaki

[11] Patent Number: 5,357,838

[45] Date of Patent: Oct. 25, 1994

[54] DRUM

[75] Inventor: Makoto Kurosaki, Shizuoka, Japan

[73] Assignee: Yamaha Corporation, Japan

[21] Appl. No.: 102,403

[22] Filed: Aug. 5, 1993

[30] Foreign Application Priority Data

Aug. 7, 1992 [JP] Japan ..... 4-055747[U]

[51] Int. Cl.[5] ..... G10D 13/02

[52] U.S. Cl. ..... 84/413

[58] Field of Search ..... 84/411 R, 411 A, 418, 84/413

[56] References Cited

U.S. PATENT DOCUMENTS 1,334,334 3/1920 Wanamaker ..... 84/413
4,334,458 6/1982 Grauso ..... 84/411 R
4,660,455 4/1987 Jones et al. ..... 84/413
5,208,412 5/1993 Hoshino ..... 84/413

*Primary Examiner*—Michael L. Gellner
*Assistant Examiner*—Patrick J. Stanzione
*Attorney, Agent, or Firm*—Ostrolenk, Faber, Gerb & Soffen

[57] ABSTRACT

In construction of a drum in which at least one open end of a cylindrical drum shell is closed by a drum head which is held in tension by assistance of a fastening element such as a suspension ring, opposite fastening elements are connected to each other by long tubes which are directly and mechanically connected to the drum shell. Not only the long tubes but also the drum shell shares mechanical load generated by tensioning of the drum head so as to elongate the life of the long tubes.

7 Claims, 3 Drawing Sheets

DRUM

BACKGROUND OF THE INVENTION

The present invention relates to a drum, and more particularly relates to improvement in mechanical strength of a drum such as a marching drum which requires high pitch tuning.

Typical examples of such a drum are disclosed in U.S. Pat. No. 4,448,105 and 4,869,146 as well as in Japanese Patent Publication Sho. 62-38710. In general, one or two drum heads are coupled to open ends of a hollow cylindrical shell which is made of wood or fiber reinforced plastic (FRP) material via several coupling members. More specifically, a suspension ring is attached to one open end of the shell and coupled, via several fastener bolts, to a counterhoop which is inserted over the suspension ring while holding a drum head in tension over the open end of the shell. The shell is also associated, near the other open end thereof, with the pair of suspension ring and counterhoop. The opposite suspension rings are coupled to each other via long tubes which are arranged along the circumference of the shell substantially at equal intervals. Accordingly, the shell is clamped between the pair of suspension rings (and counterhoops) connected to each other by the intervening long tubes.

For tuning of the drum, the fastener bolts are turned to adjust tension on the drum head. When the fastener bolts are turned to increase the tension on the drum head, the opposite suspension rings are forced to move away from each other and the intervening long tubes are subjected to tension. Whereas, when the fastener bolts are turned to decrease the tension on the drum head, the opposite suspension rings move toward each other and the long tubes are released from tension.

As stated above, the shell is clamped between the suspension rings connected to each other by the intervening long tubes and there is no direct mechanical connection between the coupling members and the shell. So, when the long tubes are subjected to repeated mechanical deformation for the purpose of drum tuning, accumulated structural fatigue tends to breakage of the long tubes. The higher is the tension on the drum head, the more frequent and significant is such breakage of the long tubes. Such vulnerable reaction of the long tubes against mechanical deformation is believed to be caused by absence of any substantial mechanical connection between the coupling members and the shell of the drum.

SUMMARY OF THE INVENTION

It is thus the principal object of the present invention to enhance mechanical strength of a drum so as to well endure repeated drum head tension adjustment.

In accordance with the present invention, a plurality of long tubes for connecting opposite suspension rings are directly and mechanically connected to a drum shell.

DESCRIPTION OF THE PREFERRED EMBODIMENTS

Figure 1:
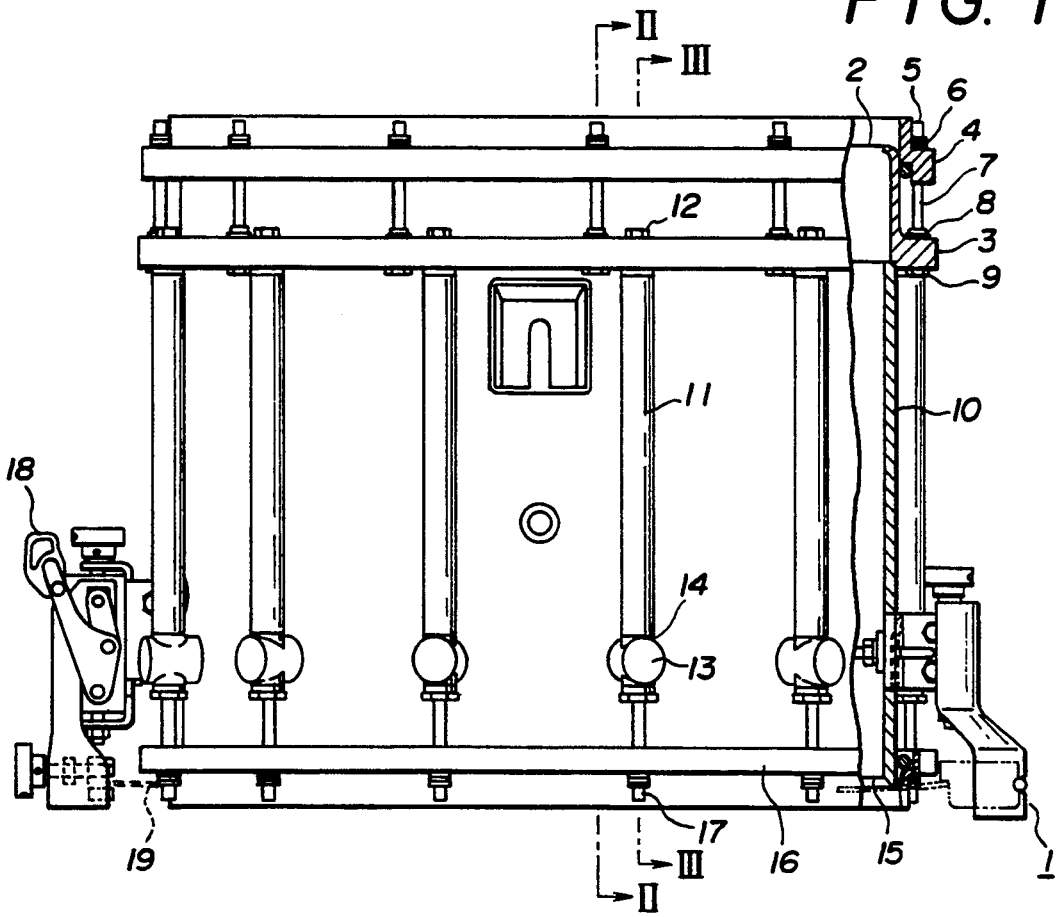
FIG. 1 is a side view, partly in section, of one embodiment of the drum in accordance with the present invention.

One embodiment of the drum in accordance with the present invention is shown in FIG. 1, in which the drum 1 is provided with a hollow cylindrical drum shell 10 open at both ends. At least one open end, i.e. the beating side open end, of the drum shell 10 is closed by a drum head 2 which generates sounds when beaten by a stick or the like. The drum shell 10 is generally make of wood or fiber reinforced plastic material. A suspension ring 3 is attached to the open end of the drum shell 10. This suspension ring 3 is made of metal or FRP material to have a strength durable against high drum head tension.

The suspension ring 3 holds the drum head 2 in tension in cooperation with an annular counterhoop 4 which is inserted over the beating side end of the suspension ring 3. The suspension ring 3 and the counterhoop 4 are connected to each other by a plurality of fastener bolts 5 arranged along the circumference of the drum shell 10 substantially at equal intervals. One end of each fastener bolt 5 is connected to the counterhoop 4 via a washer 6 and the other end is in screw engagement with a nut 9 and an O-ring 8 on the suspension ring 3. Tension on the drum head 2 is adjusted by turning the fastener bolts 5.

One the non-beating side, the shell 10 is similarly associated with a drum head 15 and a counterhoop 16.

The suspension ring 3 is associated with a plurality of long tubes 11 which are distributed along the circumference of the suspension ring 3. More specifically in FIG. 3, each long tube 11 internally accommodates a long tube bolt 30 which extends longitudinally therethrough. The upper end, i.e. the beating side end, of the long tube bolt 30 is kept in screw engagement, via a tube washer 31, with a tube lock nut 32 fixedly held in the suspension ring 3. The lower end, i.e. the non-beating side, of the long tube bolt 30 is in screw .engagement with a long tube nut 33.

Figure 2:
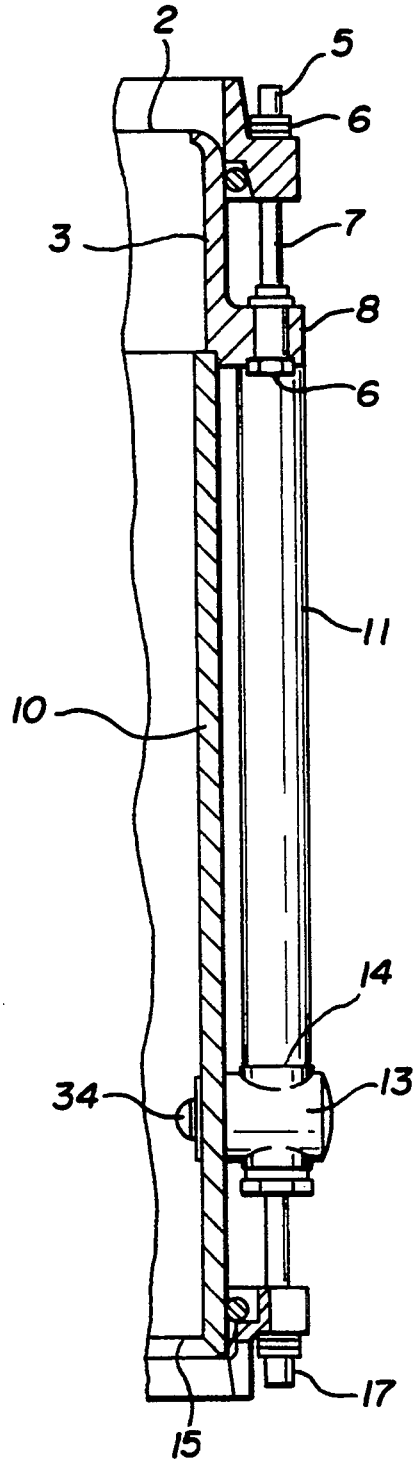
FIG. 2 is a section taken along a line II—II in FIG. 1.
Figure 3:
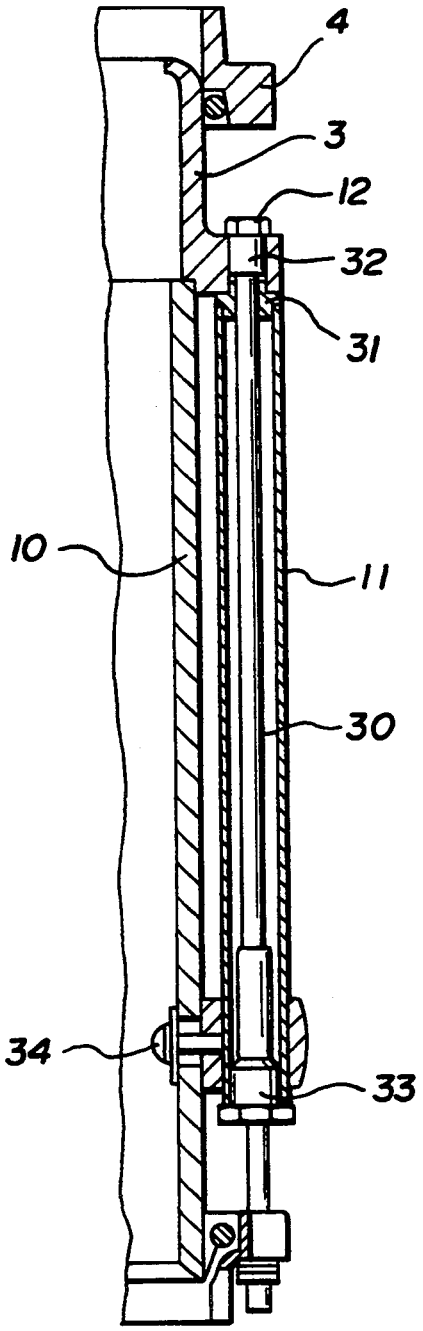
FIG. 3 is a section taken along a line III—III in FIG. 1.

Returning to FIG. 1, each long tube 11 in accordance with the present invention is fixedly connected to the drum shell 10 by a sound post 13 which is cylindrical in shape. As shown in FIG. 2, the sound post 13 is provided with a diametral bore which receives the lower end section of the long tube 11 via a cushion tube 14 made of an elastic material such as rubber. Thus, the sound post 13 is coupled to the associated long tube 11 while extending outwards in the radial direction of the drum shell 10. As shown in FIG. 3, the sound post 13 is provided, in its inner end, with a threaded hole which is in screw engagement with a set screw 34 extending radially outwards through the drum shell 10.

In the axial direction of the drum shell 10, the sound post 13 is most advantageously located at a position corresponding to one node of the vibrations of the drum head 2 in order to maintain sound quality of musical tones generated by the drum.

The lower extension of the long tube nut 33 is fixedly coupled to the lower side counterhoop 16 by means of a fastener bolt 17. Namely, the long tube 11 is connected at its upper end to the beating side suspension ring 3, at its midway point to the drum shell 10 and at its lower end to the non-beating side counterhoop 16.

The drum 1 is further provided near its lower end with a conventional snare trainer 18 which swings about its pivot when manually operated. The snare trainer 18 is connected to snares 19 which selectively contact the lower side drum head 15 when properly operated by the snare trainer 18.

In accordance with the present invention, each long tube 11 is directly and mechanically connected to the drum shell 10 by means of the associated sound post 13. As a consequence, the mechanical load generated by tensioning of the drum head 2 is shared by both the long tube 11 and the drum shell 10. This load sharing system greatly alleviates the load which would otherwise be placed on the long tube 11 which is accordingly made highly endurable against repeated drum tension adjustment.

In addition, holding of the beating side drum head 2 by the suspension ring 3 allows high degree tensioning of the drum head 2. Thus, the drum head in accordance with the present invention is advantageously used for a marching drum which generally necessitates high pitch tuning.

I claim:

1. A drum, comprising:

A) a generally cylindrical drum shell having first and second open ends;

B) a drum head support system including:

1) a suspension ring and a first counterhoop which cooperate to hold a drum head along a flat plane with a tension determined by the relative axial locations of said suspension ring and first counterhoop; and, 2) means for adjusting the relative axial locations of said suspension ring and counterhoop to adjust said tension in said drum head;

C) a drum head positioning system for positioning said drum head support system at a location which causes said drum head to cover said first open end of said drum shell, said drum head positioning system including:

1) a second counterhoop located near said second open end of said drum shell;

2) a plurality of axially extending tensioning bars coupling said first and second counterhoops; and 3) connecting means for directly and mechanically connecting each said tensioning bars to said drum shell.

2. A drum as claimed in claim 1 in which said connecting means includes a plurality of sound posts each of which extends radially outward from said drum shell with its outer end coupled to a respective said tensioning bar.

3. A drum as claimed in claim 2 in which said sound posts are located, in the axial direction of said drum shell, at a position corresponding to one node of vibrations of said drum head.

4. A drum as claimed in claim 1, wherein said positioning system further includes a second drum head covering said second open end of said drum shell and being stretched over said second open end of said drum shell by said second counterhoop.

5. A drum as claimed in claim 4, wherein said second drum head is in physical contact with edges of said drum shell located adjacent said second open end.

6. A drum as claimed in claim 5, wherein the tension in said second drum head is determined by the relative axial locations of said first and second counterhoops.

7. A drum as claimed in claim 6, wherein the relative axial location of said first and second counterhoops are a function of the tension in said tensioning bars.

* * * * *